United States Patent [19]

Bredbury et al.

[11] Patent Number: 4,536,982

[45] Date of Patent: Aug. 27, 1985

[54] CYLINDRICAL RIFLE HANDGUARD ASSEMBLY

[75] Inventors: Seth K. Bredbury, Winsted; Harold J. Waterman, Jr., Wallingford, both of Conn.

[73] Assignee: Colt Industries Operating Corp., West Hartford, Conn.

[21] Appl. No.: 544,009

[22] Filed: Oct. 21, 1983

[51] Int. Cl.[3] ..... F41C 23/00

[52] U.S. Cl. ..... 42/71 R

[58] Field of Search ..... 42/71 R, 72, 75 A

[56] References Cited

U.S. PATENT DOCUMENTS

| | | | |
|---|---|---|---|
| 2,965,994 | 12/1960 | Sullivan | 42/71 R |
| 3,075,314 | 1/1963 | Bakker | 42/71 R |
| 3,090,150 | 5/1963 | Stoner | 42/71 R |

FOREIGN PATENT DOCUMENTS

| | | | |
|---|---|---|---|
| 546750 | 4/1956 | Belgium | 42/71 R |

*Primary Examiner*—Charles T. Jordan
*Assistant Examiner*—Ted L. Parr
*Attorney, Agent, or Firm*—Radford W. Luther; Richard A. Dornon

[57] ABSTRACT

A round handguard assembly for a rifle barrel (18) has substantially identical bottom and top mating sections (26, 28) covering the barrel. Each section has a generally cylindrical outer shell (32) and a generally cylindrical liner (34). Each shell has a plurality of centrally located vent holes (36) arranged in a longitudinal row and three equally spaced lugs (52, 54, 56) on its front end. Each liner has a rear segment devoid of vent holes with a flange (62) projecting from one of its sides and a front segment with a plurality of centrally located vent holes (60) arranged in a longitudinal row and registering with certain of the vent holes in the shell. The flanges on each liner overlap a side of the confronting liner to provide a radially sealed annular volume around the barrel for preventing heat transfer to the rear portions of the shells so that a user may comfortably grip the handguard assembly. The lugs on the front of the handguard assembly may accommodate a triangular cap (25) or a round cap.

12 Claims, 8 Drawing Figures

Fig. 6
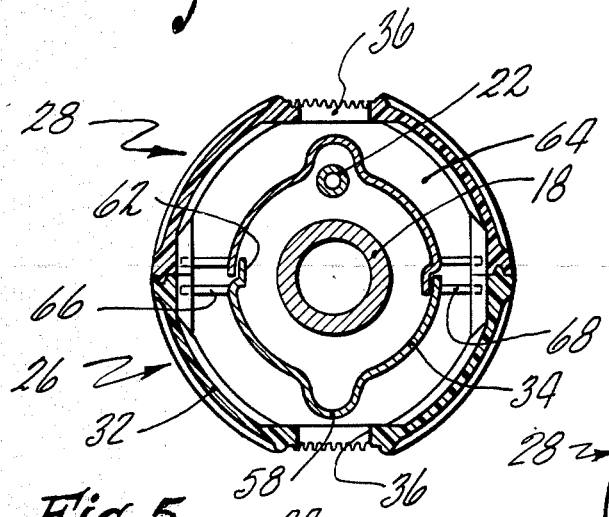
Fig. 7
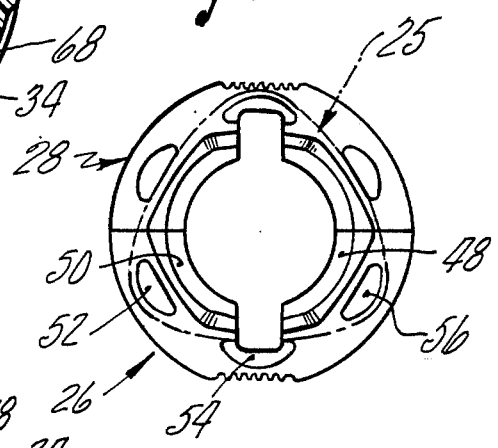
Fig. 5
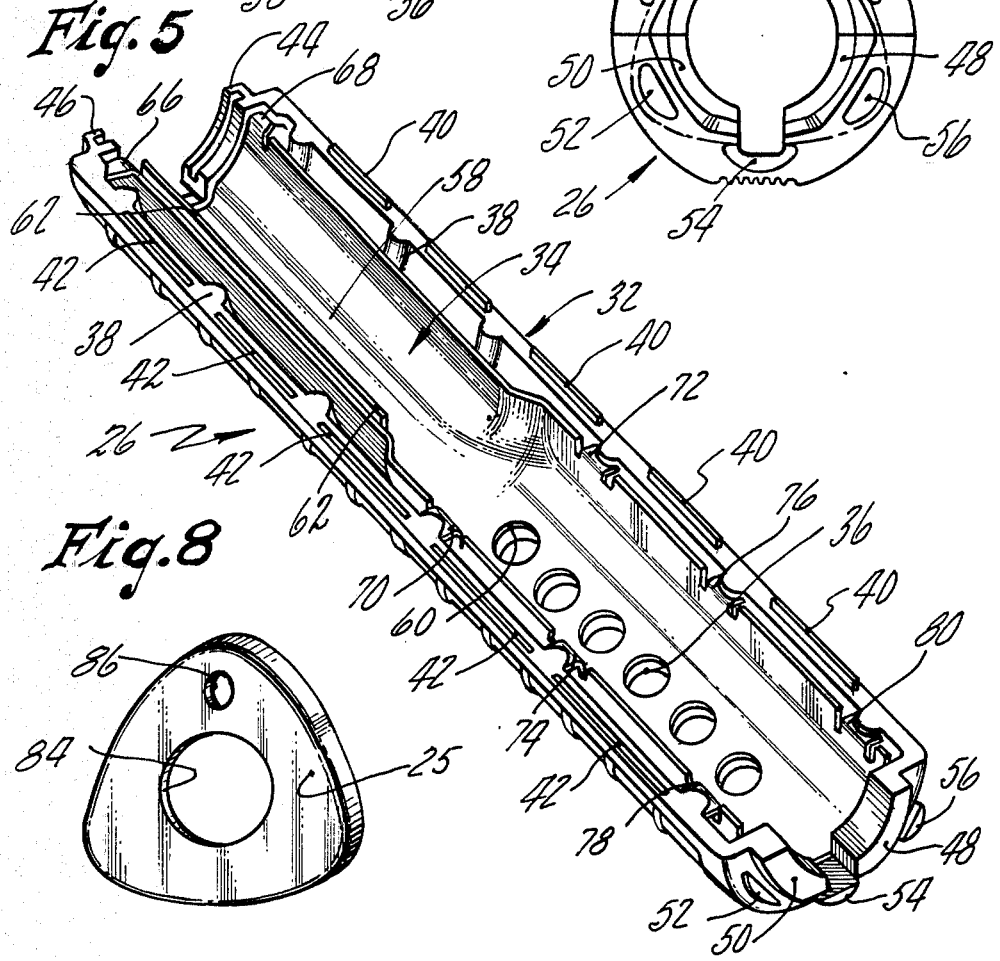
Fig. 8

CYLINDRICAL RIFLE HANDGUARD ASSEMBLY

TECHNICAL FIELD

This invention relates to handguard assemblies for rifles.

BACKGROUND ART

Present M16 type rifles utilize a triangular handguard assembly which engages a triangular handguard cap in abutting relationship with the front sight. Such existing handguards typically consist of dissimilar left and right sections which mate to define an upper and lower row of vent holes. While the aforementioned handguard exhibits satisfactory performance, it does suffer from certain drawbacks.

Prominent among such drawbacks is the difficulty of a user in securing a firm grip because of the smooth surface. In addition, present handguards are somewhat susceptible to impact breakage in the area of the vent holes; and the front portions and vented areas have a tendency to heat up after repeated firings to temperatures which produce uncomfortable sensations in a user's hand.

DISCLOSURE OF THE INVENTION

In accordance with the invention, there is provided a round handguard assembly for an M16 type rifle or other type of automatic rifle which comprises identical top and bottom mating sections, thereby eliminating the need for two sections of differing construction. Each section comprises an outer shell and a liner. Because the handguard assembly of the invention is of a ribbed, rounded configuration, an improved grip is possible. In addition, the use of top and bottom sections permits the handguard assembly to exhibit greater strength in the areas adjacent the vent holes, which extend longitudinally along the length of the handguard assembly, thereby rendering the handguard assembly less susceptible to breakage.

A handguard assembly of the invention employs liners whose rear portions are devoid of vent holes and interlock to reduce heat flow between mating surfaces of the handguard in the rear portion thereof. The vent holes in the rear portions of the shells serve to circulate air between the liners and the outer shells for cooling the exterior surface of the handguard.

As a further feature of a handguard assembly of the invention, the front portion thereof is configured to accept either a standard triangular handguard cap or a rounded cap. Because of this arrangement, a handguard assembly of the invention can readily be retrofited to existing M16 type rifles without removal of the front sight to install a cap of different configuration.

Accordingly, it is a primary object of the invention to provide a handguard assembly for an M16 type rifle or other type of automatic rifle.

This and other objects and advantages of the invention will become more readily apparent from the following detailed description taken in conjunction with the accompanying drawings:

BRIEF DESCRIPTION OF DRAWINGS

FIG. 5 is a perspective view of one of the sections of the handguard assembly.

FIG. 6 is a sectional view of the rifle of FIG. 1, taken along the line 6—6 of FIG. 1.

FIG. 7 is a front elevational view of the handguard assembly, per se.

FIG. 8 is a perspective view of a conventional triangular handguard cap.

BEST MODE OF CARRYING OUT THE INVENTION

Figure 2:
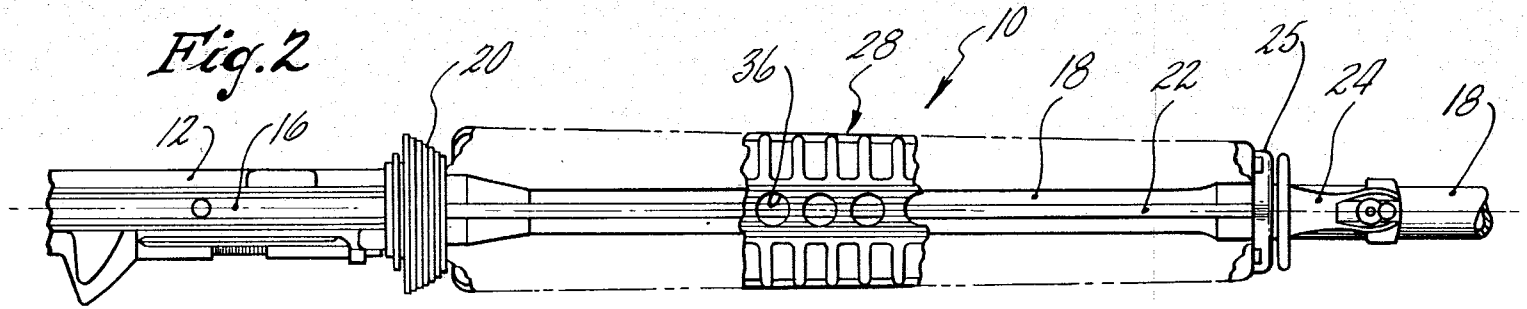
FIG. 2 is a fragmentary top plan view of the rifle of FIG. 1, taken substantially along the line 2—2 of FIG. 1.
Figure 1:
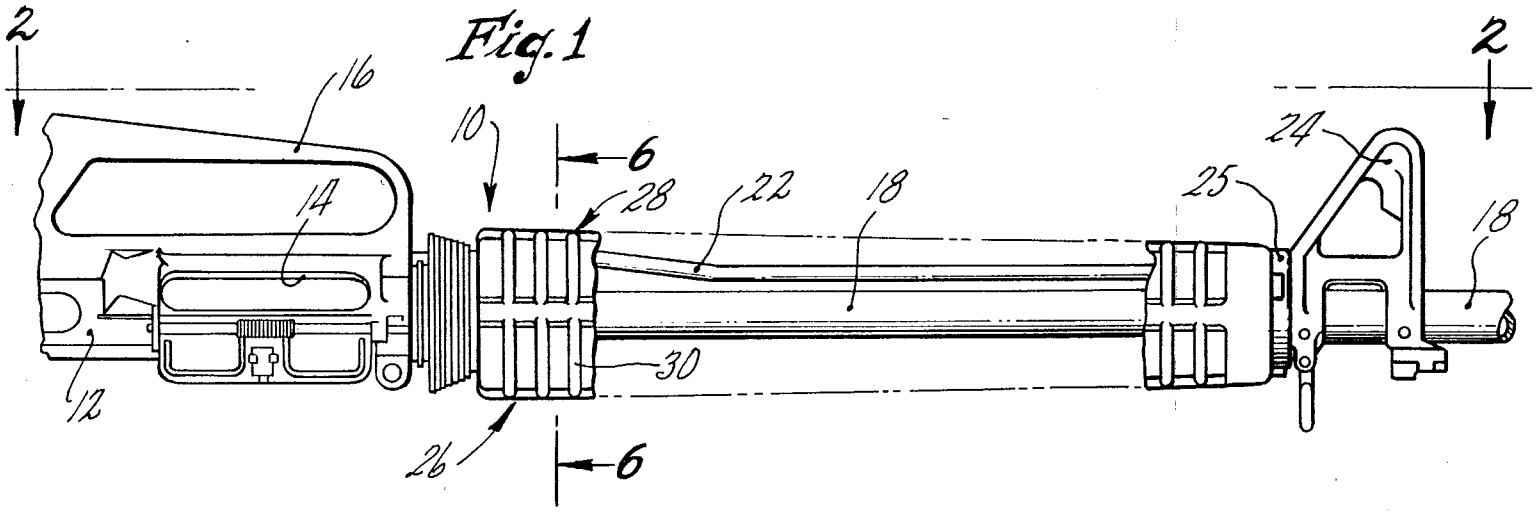
FIG. 1 is a fragmentary side elevational view of a rifle incorporating a handguard assembly of the invention.

With reference to FIGS. 1 and 2 there is shown a conventional M16 type rifle incorporating a handguard assembly of the invention, generally shown at 10. The rifle incorporates the usual upper receiver section 12 having an ejection port 14 and a carrying handle 16. Extending from the upper receiver section 12 is a barrel 18 and a slip ring 20 for securing the rear end of the handguard assembly. The slip ring 20 can be rearwardly displaced against a spring load to release the handguard assembly and permit removal thereof. Also communicating with the upper receiver section 12 is a gas tube 22 which supplies gas to operate the firing mechanism. A sight and gas tube assembly 24 is mounted upon the barrel 18 adjacent the front end of the handguard assembly 10 in communication with the gas tube 22. Interposed between the sight and gas tube assembly 24 and the front end of the handguard assembly is a triangular handguard cap 25 which functions to clamp the sections of the handguard together and furnish a forward abutment surface.

With continued reference to FIGS. 1 and 2, it will be noted that the handguard assembly 10 is comprised of a lower section and an upper section, generally designated 26 and 28, respectively. The sections 26 and 28 are in all respects identical and define a handguard assembly of generally circular cross section with a progressively decreasing diameter in the forward direction. Ribs 30 are provided on the exterior portions of the sections to enhance structural integrity and provide for a firm grip.

Figure 4:
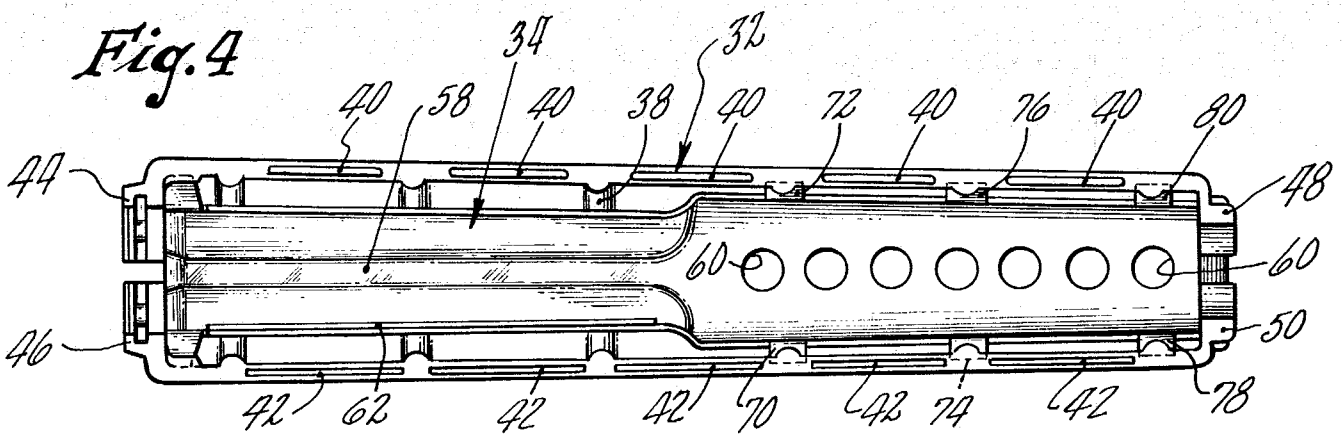
FIG. 4 is top plan view of one of the sections of the handguard assembly, showing the liner installed in the shell.
Figure 3:
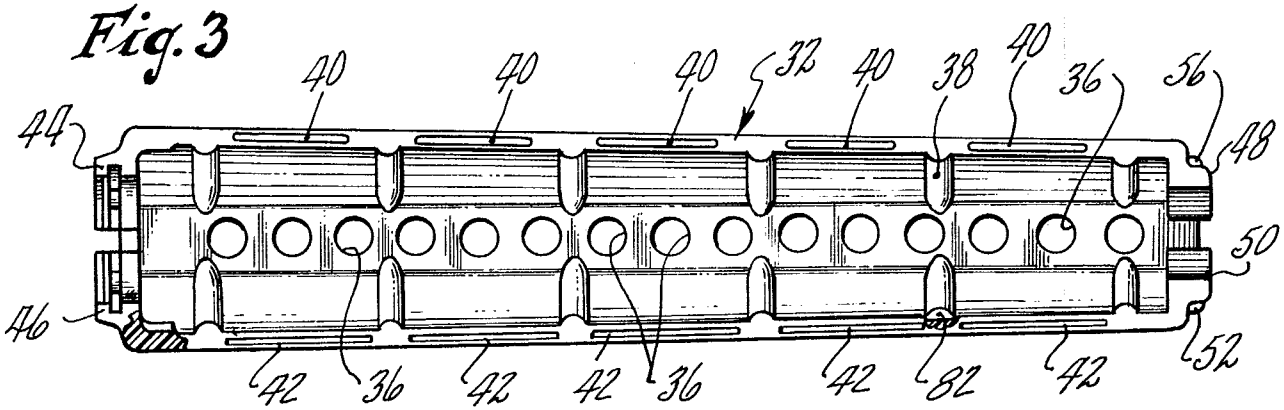
FIG. 3 is a top plan view of a shell, per se.

Referring to FIGS. 3–5, it may be seen that section 26 of the handguard assembly 10, which is identical to section 28, is constituted by an outer, generally semicylindrical shell generally shown at 32, and an inner handguard liner, generally shown at 34. The shell 32 is preferably made of a plastic thermosetting, plastic compound FM-8130E (or equivalent) available from Fiberite Corp and the liner 34 is preferably constituted by an aluminum alloy stamping.

The shell 32 has a plurality of vent holes 36 arranged in a longitudinal row in the center thereof. The vent holes 36 extend substantially from the front to rear of the shell 32 and provide cooling for the barrel 18 and the liner. The interior of the shell 32 is formed with a plurality of stiffening ribs 38. The right (FIG. 5) or top (FIG. 3) edge of the shell 32 has a plurality of tongues 40 projecting therefrom while the lower or left edge of the shell has a plurality of grooves 42 formed therein. The tongues of each shell are adapted to fit into the grooves of the shell of the confronting section when the handguard assembly sections are assembled as shown in FIGS. 1 and 2.

The rear end of the shell 32 embodies two arcuate extensions 44 and 46 which, with the corresponding arcuate extensions of the confronting section 28, are received within the slip ring for clamping the sections 26 and 28 together. The front end of the shell 32 incorporates two arcuate extensions 48 and 50 adapted to be inserted in the handguard cap 25. Formed on the front end of the handguard assembly section 26 between the outer periphery thereof and the extensions 48 and 50 are three equally spaced lugs 52, 54 and 56 upon which the triangular cap may be seated, as more fully described hereinafter.

As best shown in FIGS. 4, 5 and 6, the liner 34 is generally of a semi-cylindrical configuration and has a forward segment slightly wider than the rear segment. The rear segment has a longitudinal ridge 58 running along the center thereof and the forward segment has a plurality of vent holes 60 which lie in a centrally disposed longitudinal row. The vent holes 60 register with the vent holes 36 in the forward position of the shell. The rear segment of the liner 34 is also provided with a flange 62 which extends upwardly from the left side of the rear segment of the liner 34, as viewed in FIG. 5. As shown in FIG. 6, the flange is disposed in a location radially inward of the side of the liner from which it projects, whereby, in the handguard assembly, the outboard surface flange 62 engages the inboard surface of the confronting liner so as to form a laterally sealed annular volume 64 surrounding the liners. In order to mount the liner 34 in the shell, tabs 66, 68, 70, 72, 74, 76, 78 and 80 are provided on the liner 34 and extend laterally from the sides thereof. The tabs are received within lateral slots (such as shown at 82 in FIG. 3) in the ribs 38 adjacent the sides of the liner 34. When properly mounted in the shell 32, the liner 34 is spaced a small distance from the inner periphery thereof.

FIG. 7 is a front end view of the assembled handguard with the outline of a triangular cap 25 superimposed in phantom thereupon. As depicted in FIG. 7, the side wall of the cap 25 extends over alternate lugs such that the other lugs lie beyond the side wall. As shown in FIG. 8, the cap 25 has apertures 84 and 86 through which the barrel 18 and gas tube 22 respectively extend. Because the lugs 52, 54 and 56 have their radially outer surfaces at the same radial distance from the handguard assembly or barrel axis, a circular cap could be equally well accommodated with its side wall engaging the outer surfaces of the lugs. It will be appreciated that the disclosed lug arrangement permits either section of the handguard assembly to be placed in an upper position or in a lower position and still be accepted by a conventional triangular cap.

During operation of the firearm, the interlocking rear segments of the liners 34 will reduce heat flow to the annular volume 64 whereby the rear portion of the handguard assembly which is gripped by a user will remain relatively cool. The vent holes 60 in the liner which register with the forward vent holes 36 in the shell 32 function to cool the barrel 18 whereas the vent holes 36 in the rear portion of the shell 32 allow air to circulate between the liner 34 and the shell 32 for cooling the shell 32.

Obviously, many modifications and variations are possible in light of the above teachings without departing from the scope or spirit of the invention as defined in the appended claims:

What is claimed is:

1. A handguard assembly for a rifle barrel comprising:

first and second shells having generally semicylindrical shapes, each shell having a plurality of vent holes arranged in a longitudinal row in the center thereof extending substantially from the front to the rear of the shell, the first shell being adapted to be placed over the top of the barrel with the sides of the first shell disposed laterally of the barrel and the second shell adapted to be placed under the bottom of the barrel with the sides of the second shell disposed laterally of the barrel in mating engagement with the sides of the first shell so as to define a generally cylindrical handguard around the barrel, the front and rear of the shells having surfaces for mounting the handguard upon the barrel and clamping the first shell and second shell together to hold the sides thereof in mating engagement;

a first liner, having a forward segment and a rear segment, of generally semi-cylindrical configuration mounted in the first shell, the forward segment of the first liner having a plurality of vent holes which define a centrally disposed longitudinal row, the vent holes in the forward segment of the first liner registering with certain of the vent holes in the first shell for cooling the barrel, the rear segment of the first liner covering the adjacent vent holes in the first shell and having a flange which projects from a side thereof; and a second liner, having a forward segment and a rear segment, of generally semi-cylindrical configuration mounted in the second shell, the forward segment of the second liner having a plurality of vent holes which define a centrally disposed longitudinal row, the vent holes in the forward segment of the second liner registering with certain of the vent holes in the second shell for cooling the barrel, the rear segment of the second liner covering the adjacent vent holes in the second shell and having a flange which projects from a side thereof, the flange of the second liner overlapping a side of the first liner and the flange of the first liner overlapping a side of the second liner for radially sealing the annular volume between the barrel and the rear segments of the first and second liners to reduce heat flow to the rear portions of the shells where a user's hand may be placed.

2. A handguard assembly, as defined in claim 1, further comprising:

a plurality of spaced lugs on the front of the first shell; and a plurality of spaced lugs on the front of the second shell, the lugs of the first and second shells arranged in a circular array for defining the front mounting and clamping surfaces which may accommodate either a triangular cap or a circular cap.

3. A handguard assembly, as defined in claim 2, wherein plurality of spaced lugs on the second shell is constituted by three lugs on the front of each shell.

4. A handguard assembly, as defined in claim 1, wherein the first and second shells each further comprise:

a plurality of ribs on the interior of the shell and a plurality of ribs on the exterior of the shell.

5. A handguard assembly, as defined in claim 4, wherein each liner further comprises:

a plurality of tabs extending laterally from the sides thereof into certain of the ribs of the associated shell.

6. A handguard assembly, as defined in claim 5, wherein the sides of the first and second shells comprise:

means to interlock the first and second shells.

7. A handguard assembly, as defined in claim 6, wherein the first and second shells and the first and second liners are of identical construction.

8. A section of a rifle barrel handguard assembly adapted to be formed by two substantially identical sections which section comprises:

a shell having a generally semi-cylindrical shape, the shell having a plurality of vent holes arranged in a longitudinal row in the center thereof extending substantially from the front to the rear of the shell, the shell being adapted to be placed around a barrel with the sides of the shell disposed laterally of the barrel, the front and rear of the shell having surfaces for mounting the shell upon the barrel and clamping the shell and an identical shell together; and a liner, having a forward segment and a rear segment, of generally semi-cylindrical configuration, mounted in the shell, the forward segment of the liner having a plurality of vent holes which define a centrally disposed longitudinal row, the vent holes in the forward segment of the liner registering with certain of the vent holes in the shell for cooling the barrel, the rear segment of the liner covering the adjacent vent holes in the shell and having a flange which projects from a side thereof.

9. A section, as defined in claim 8, further comprising:

a plurality of spaced lugs on the front of the shell arranged in a semi-circular array for defining the front mounting and clamping surfaces.

10. A section, as defined in claim 9, wherein the plurality of spaced lugs on the shell is constituted by three lugs on the front of the shell.

11. A section, as defined in claim 8, wherein the shell further comprises:

a plurality of ribs on the interior of the shell and a plurality of ribs on the exterior of the shell.

12. A section, as defined in claim 11, wherein the liner further comprises:

a plurality of tabs extending laterally from the sides thereof into certain of the ribs of the shell.

* * * * *